US005298156A

United States Patent [19]

Blanc et al.

[11] Patent Number: 5,298,156

[45] Date of Patent: Mar. 29, 1994

[54] SIMULTANEOUS DECARBONATION AND GASOLINE STRIPPING OF HYDROCARBONS

[75] Inventors: Claude Blanc, Pau; Henri Paradowski, Cergy, both of France

[73] Assignee: Societe Nationale Elf Aquitaine (Production), Courbevoie, France

[21] Appl. No.: 543,714

[22] PCT Filed: Dec. 14, 1989

[86] PCT No.: PCT/FR89/00584

§ 371 Date: Jul. 14, 1990

§ 102(e) Date: Jul. 14, 1990

[87] PCT Pub. No.: WO90/05766

PCT Pub. Date: May 31, 1990

[30] Foreign Application Priority Data

Nov. 15, 1988 [FR] France ..... 88 14784

[51] Int. Cl.[5] ..... C10G 5/04; C10G 5/06

[52] U.S. Cl. ..... 208/341; 208/340; 208/343; 95/236; 95/237; 95/169; 95/163

[58] Field of Search ..... 208/340, 341; 55/68; 62/11; 423/220

[56] References Cited

U.S. PATENT DOCUMENTS

| | | | |
|---|---|---|---|
| 1,838,444 | 12/1931 | Porter | 208/341 |
| 1,898,579 | 2/1933 | Gard | 208/341 |
| 1,953,043 | 3/1934 | Cole, Jr. et al. | 208/341 |
| 1,972,060 | 8/1934 | Cole, Jr. et al. | 208/341 |
| 2,487,576 | 11/1949 | Meylis | 208/341 |
| 2,930,752 | 3/1960 | Swerdloff | 208/341 |
| 3,210,270 | 10/1965 | Fryar | 208/341 |
| 3,247,649 | 4/1966 | Miller | 208/341 |
| 3,347,621 | 10/1967 | Papadopolus | 208/341 |
| 3,770,622 | 11/1973 | Freireich et al. | 208/341 |
| 3,829,521 | 8/1974 | Green | 208/341 |
| 4,293,322 | 10/1981 | Ryan | 55/68 |
| 4,305,733 | 12/1981 | Scholz et al. | 55/68 |
| 4,568,452 | 2/1986 | Richmond | 208/341 |
| 4,654,062 | 3/1987 | Gottier | 208/341 |
| 4,747,858 | 5/1988 | Gotier | 55/68 |
| 4,775,396 | 10/1988 | Raslelli et al. | 55/68 |
| 4,934,146 | 6/1990 | Wilheim et al. | 55/68 |

*Primary Examiner*—Helane Myers

*Attorney, Agent, or Firm*—Burgess, Ryan and Wayne

[57] ABSTRACT

Process for the simultaneous decarbonation and gasoline stripping of a gaseous mixture at an absolute pressure higher than 0.5 MPa containing methane, $C_2$ and higher hydrocarbons and $CO_2$ in which a demethanized rich solvent is regenerated so the process can be carried out more easily and at lower costs than previously known systems.

28 Claims, 3 Drawing Sheets

SIMULTANEOUS DECARBONATION AND GASOLINE STRIPPING OF HYDROCARBONS

FIELD OF THE INVENTION

The invention relates to a process for the simultaneous decarbonation and gasoline stripping of a gaseous mixture comprising hydrocarbons consisting of methane and $C_2$ and higher hydrocarbons and also containing $CO_2$ and possibly one or more nonsulphur compounds of low boiling point such as $H_2$, CO, $N_2$ and argon.

The process according to the invention makes it possible to separate a gaseous mixture of the abovementioned type directly into three components, namely:

a treated gas comprising methane and $C_2$ hydrocarbons and whose $CO_2$ molar content does not 2%, a hydrocarbon cut containing at least 80 mol% of $C_3$ and higher hydrocarbons present in the gaseous mixture to be treated and an acidic gas stream comprising $CO_2$ containing less than 10 mol% of hydrocarbons, expressed as methane equivalent, relative to the $CO_2$.

BACKGROUND OF THE INVENTION

A number of industrially employed processes are known for the treatment of gaseous mixtures such as defined above and whose main examples are represented by the various natural gases, which comprise a decarbonation operation, that is a $CO_2$ removal, and a gasoline stripping operation, that is a separation of the heavy hydrocarbons, for example $C_3$ and higher, from the gaseous mixture and allowing the said gaseous mixture to be fractionated into the three components referred to above.

These decarbonation and gasoline stripping operations are generally performed separately and form part of a series of operations performed on the gaseous mixture to be treated and comprising chiefly a removal of the $CO_2$ acidic gas, a drying operation, a water adsorption on a suitable solid such as a molecular sieve, a separation by cryogenic distillation between −30° C. and −90° C. coupled or otherwise with an extraction with a solvent in order to obtain the liquid cut of natural gas and, lastly, heating the treated gas to room temperature, generally in order to feed a commercial gas grid.

In such a scheme of treatment of the gaseous mixture of the natural gas type, containing the abovementioned constituents, lowering of the temperature of the gaseous mixture is made necessary only by the production of the liquid cut of natural gas, no other operation being performed at this temperature level.

In this treatment scheme, the serial carrying out of operations which are based on quite different principles and which are conducted at different temperature levels presents considerable disadvantages. There is very little possibility of thermal integration, and this makes the said treatment scheme extremely costly in terms of energy and in terms of capital cost.

There are also known processes for the treatment of gaseous mixtures of the natural gas type, which make it possible to remove the $CO_2$ present in the gaseous mixture simultaneously with the production of gaseous hydrocarbons and liquid hydrocarbons and typical of which is the process known as the Ryan-Holmes process and described, in particular, by J. Ryan and F. Schaffert in the journal Chemical Engineering Progress, October 1984, pages 53 to 56. In a process of this kind, after having been dehydrated conventionally and then refrigerated, the natural gas to be treated is subjected to a low-temperature distillation carried out in three or four successive stages.

In the three-stage method of operation the dehydrated and refrigerated natural gas is separated, in a first (demethanizer) column into the top of which is injected an additive consisting of a liquid $C_4$ and higher hydrocarbon fraction, into a gaseous phase containing methane and lighter compounds, and a liquid fraction containing the $C_2$ and higher hydrocarbons and $CO_2$. This liquid fraction is separated, in a second (de-ethanizer) column, into which a certain quantity of the additive is also introduced, into a head fraction consisting of $CO_2$ and a tail fraction containing $C_2$ and higher hydrocarbons. The tail fraction is then separated, in a third column, into a head fraction consisting of a liquid $C_2$–$C_4$ hydrocarbon fraction and a tail fraction consisting of a liquid $C_4$ and higher hydrocarbon cut. This cut contains most of the butanes and higher hydrocarbons present in the treated natural gas and from which the appropriate quantity is removed to constitute the additive injected into the first and second columns. The use of this additive prevents the crystallization of $CO_2$ at the head of the demethanizer and ensures the breaking of the azeotrope which is formed between ethane and $CO_2$ and facilitates the separation of these compounds in the de-ethanizer. The abovementioned process relies, therefore, essentially on operations of distillation in series.

SUMMARY OF THE INVENTION

The present invention proposes a process for the simultaneous decarbonation and gasoline stripping of gaseous mixtures which are available at an absolute pressure higher than 0.5 MPa and which are comprised of hydrocarbons methane and $C_2$ and higher hydrocarbons and which also contain $CO_2$ and possibly one or more nonsulphur compounds of low boiling point, such as $H_2$, CO, $N_2$ and argon, such gaseous mixtures being, for example, of the natural gases type. The process making it possible to achieve, more easily and at lower cost, when compared with the known processes, the objective of a separation of the gaseous mixture into the three components, namely treated gas comprising methane, a liquid hydrocarbon cut with mostly $C_3$ and higher hydrocarbons and containing a more or less considerable quantity of ethane according to need, and a $CO_2$ stream, which have the specifications defined above.

The process according to the invention is a process of the type which is described in the reference U.S. Pat. No. 3,770,622 to the gaseous mixture is brought into contact, in a washing zone, with a solvent comprising a liquid which dissolves $CO_2$ and $C_2$ and higher hydrocarbons and which has, on the one hand, at atmospheric pressure, a boiling temperature higher than 40° C. and, on the other hand, at −30° C., a viscosity lower than 0.1 Pa s. The process is operated at a sufficiently low temperature and with a ratio of the flow rates of gaseous mixture to be treated and of solvent which is such as to produce, on the one hand, a treated gas containing chiefly methane and exhibiting a $CO_2$ molar content not exceeding 2% and a liquid phase called rich solvent composed of the $CO_2$-enriched solvent and of a $C_2$ and higher hydrocarbon fraction containing at least 80 mol% of the $C_3$ and higher hydrocarbons which are present in the gaseous mixture to be treated. The rich solvent is subjected to at least a partial demethanization treatment to produce a methane-depleted liquid phase called demethanized rich solvent and a methane-rich gaseous phase which may be optionally recombined with the gaseous mixture to be treated before the latter is brought into contact with the solvent, and the demethanized rich solvent is subjected to a treatment producing an acidic gas stream which contains virtually all the $CO_2$ present in the demethanized rich solvent, also producing a mixture of hydrocarbons called a hydrocarbon cut and finally producing a regenerated solvent which is recycled the washing zone.

The process according to the invention is distinguished from the process of reference U.S. Pat. No. 3,770,622 and is therefore characterized in that the treatment of the demethanized rich solvent is performed to make the acidic gas stream which it produces contain less than 10 mol% of hydrocarbons, expressed as methane equivalent in relation to $CO_2$, and to make the hydrocarbon cut obtained contain a mixture of $C_2$ and higher hydrocarbons having at least 80 mol% of the $C_3$ and higher hydrocarbons which are present in the gaseous mixture to be treated. The treatment of the demethanized rich solvent comprising of one or other of the following treatments a), b) and c):

a) — regenerating of the demethanized rich solvent producing the regenerated solvent and a gaseous mixture containing the $CO_2$ and the $C_2$ and higher hydrocarbons which are present in the demethanized rich solvent and treatment of the said gaseous mixture to produce the $CO_2$-rich acidic gas stream and the hydrocarbon cut, b) — extracting the $C_2$ and higher hydrocarbons in liquid form by bringing the demethanized rich solvent, subjected to a refrigeration beforehand, into contact with a hydrocarbon solvent, in an extraction zone, to produce a purified solvent containing virtually all the $CO_2$ present in the demethanized rich solvent and having a hydrocarbon content, expressed as methane equivalent, lower than 10 mol% relative to $CO_2$ as well as a hydrocarbon solvent enriched in $C_2$ and higher hydrocarbons. The purified solvent is then regenerated to produce, on the one hand, the regenerated solvent, and, on the other hand, the $CO_2$-rich acidic gas stream and fractionation of the enriched hydrocarbon solvent by distillation into a $C_2$ and higher hydrocarbon fraction constituting the hydrocarbon cut and into the regenerated hydrocarbon solvent which is recycled, after refrigeration, the extraction zone, and c) — cooling of the demethanized rich solvent to a temperature which is sufficiently lower than the temperature prevailing in the washing zone to produce a demixing of the demethanized rich solvent into two fractions. The first fraction is a lower liquid fraction which contains virtually all of the $CO_2$ present in the demethanized rich solvent and which has a hydrocarbon content, expressed as methane equivalent, lower than 10 mol% relative to $CO_2$ and which constitutes a purified solvent. The second fraction is an upper liquid fraction which constitutes the $C_2$ and higher hydrocarbon cut, and regeneration of the purified solvent to produce the regenerated solvent and, the $CO_2$-rich acidic gas stream.

DETAILED DESCRIPTION OF THE INVENTION

"Methane equivalent" according to the invention refers to as many pseudomolecules containing a single carbon atom as there are carbon atoms in the hydrocarbon molecule being considered.

The solvent which is defined generally above for bringing into contact with the gaseous mixture to be treated for the purpose of absorbing $CO_2$ and the $C_2$ and higher hydrocarbons preferably has a viscosity lower than 0.05 Pa s.

The solvent according to the invention comprises at least one selective liquid absorbent for $CO_2$ employed in anhydrous form or as a mixture with water, the solvent being selected from the group consisting of the amides of formulae

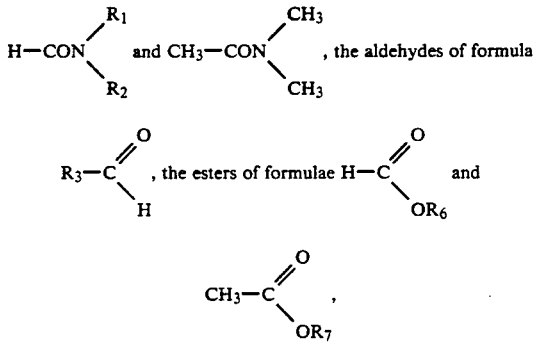

$C_1$–$C_4$ alkanols, diethers of the formula $CH_3$-O-[-$C_2H_4O$-]$_n$-$CH_3$, diether alcohols of formula $R_9O$-$C_2H_4$-O-$C_2H_4$-OH, lactones of formula

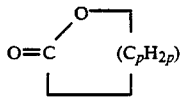

and propylene carbonate, wherein, in these formulae, $R_1$ and $R_2$, which are identical or different, denoting a hydrogen atom or a $C_1$ or $C_2$ alkyl radical, $R_3$ being a $C_3$ or $C_4$ alkyl radical, $R_6$ being a $C_2$–$C_4$ alkyl radical or a -[-$C_2H_4O$-]$_n$-$R_8$ radical with $R_8$ denoting a $C_1$ or $C_2$ alkyl radical and n being equal to 1 or 2, $R_7$ being a $C_1$ or $C_2$ alkyl radical or a -[-$C_2H_4O$-]$_n$-$R_8$ radical, $R_9$ denoting a $C_1$–$C_4$ alkyl radical and p being an integer ranging from 2 to 4.

Nonlimiting examples of liquid organic absorbents corresponding to the above formulae are those such as N,N-dimethylformamide, N,N-dimethylacetamide, dimethoxymethane, diethoxymethane, 1,1-dimethoxyethane, methanol, ethanol, ethylene glycol dimethyl ether, diethylene glycol dimethyl ether, ethylene glycol monomethyl ether, butyrolactone, propiolactone and propylene carbonate.

The temperature at which the contact between the gaseous mixture to be treated and the solvent is brought about in the washing zone is preferably between 0° C. and −45° C.

The washing zone preferably comprises at least one washing column containing the appropriate number of theoretical washing stages, the at least one column being, for example, of the tray column or else packed column type. The temperature in each of the washing columns is preferably kept substantially constant by indirect heat exchange carried out at one or more points in the column in question between the fluid medium present in the column and a refrigerant fluid.

The demethanization treatment applied to the rich solvent is carried out preferably in two stages, namely a first stage in which the rich solvent is subjected to a first expansion to an intermediate pressure capable of releasing a large fraction of the methane dissolved in the solvent to be demethanized and of producing a first methane-rich gas and a predemethanized fluid, and a second stage in which the predemethanized fluid is subjected to a second expansion and then to a distillation to produce a second methane-rich gas and the demethanized rich solvent, the second methane-rich gas being compressed up to the pressure of the first methane-rich gas and then mixed with the latter to constitute the methane-rich gaseous phase.

The methane-rich gaseous phase resulting from the demethanization treatment applied to the rich solvent is preferably compressed up to the pressure of the gaseous mixture to be treated, and it is then cooled and mixed with the gaseous mixture to be treated before the latter is brought into contact with the solvent in the washing zone.

In particular, when the treatment a) is applied to the demethanized rich solvent, the treatment of the gaseous mixture containing the $CO_2$ and the $C_2$ and higher hydrocarbons, which is produced during the regeneration stage of the treatment a), comprises a washing of the gaseous mixture by bringing the gaseous mixture into contact with a $C_5$ and higher hydrocarbon solvent in a washing capacity operating at low temperature so as to produce the $CO_2$-rich acidic gas stream and a rich hydrocarbon solvent containing almost all of the $C_2$ and higher hydrocarbons present in the gaseous mixture and practically free from $CO_2$, the washing being followed by a regeneration of the rich hydrocarbon solvent to produce the $C_2$ and higher hydrocarbon cut and a regenerated hydrocarbon solvent which is recycled the washing zone.

The regeneration of the demethanized rich solvent, carried out during the treatment a), is preferably performed by heating the solvent up to a temperature close to the surrounding temperature, by splitting the warmed-up solvent into a first and a second stream, by directing the first stream directly towards a regeneration zone, by directing the second stream towards the regeneration zone after it has been reheated by indirect heat exchange with the regenerated solvent and by subjecting the solvent to a distillation in the regeneration zone. The distillation may be carried out in the presence of a stream of inert gas, for example nitrogen, injected into the regeneration zone.

When the treatment c) is applied to the demethanized rich solvent, the temperature which is lower than the temperature prevailing in the washing zone and to which the said demethanized rich solvent is cooled to produce its demixing, is preferably more particularly between −25° C. and −80° C.

The regeneration of the purified solvent produced in either of the treatments b) and c), which results in the production of the $CO_2$-rich acidic gas stream and having a hydrocarbons content, expressed as methane equivalent, lower than 10 mol% relative to $CO_2$, can be performed using any treatment enabling the gaseous compounds dissolved in a liquid to be released. In particular, the regeneration of the purified solvent may be performed by expansion of the said purified solvent to a pressure which is higher than 100 kPa and is, for example, between 150 kPa and 300 kPa and by stripping by means of an inert gas such as nitrogen, optionally coupled with a reheating of the purified solvent in the regeneration zone.

The regeneration of the purified solvent may also be carried out by reheating the purified solvent up to a temperature close to the surrounding temperature, splitting the warmed-up solvent into a first and a second stream, directing the first stream directly a regeneration zone, directing the second stream this regeneration zone after it has been reheated by indirect heat exchange with the regenerated purified solvent, and by subjecting the solvent to a distillation in the regeneration zone in order to produce the regenerated solvent and the $CO_2$-rich acidic gas stream provided by the process.

When the gaseous mixture to be treated contains water and/or $C_5$ and higher hydrocarbons, it is advantageously subjected to a pretreatment intended to remove all or part of these compounds before being brought into contact with the solvent in the washing zone. This pretreatment may comprises a distillation which is optionally performed in the presence of solvent taken from the solvent injected into the washing zone, to produce the pretreated gaseous mixture having a $C_6$ and higher hydrocarbon content lower than 0.1% by weight, a so-called heavy hydrocarbon fraction containing virtually all of the $C_6$ and higher hydrocarbons and all or part of the $C_5$ hydrocarbons and, possibly, a liquid consisting of a mixture of solvent and water. The distillation of the gaseous mixture is carried out at a temperature which is at least equal to the temperature prevailing in the washing zone.

BRIEF DESCRIPTION OF THE DRAWINGS

The invention will be understood better on reading the description which is given below, of several of its embodiments making use of the plant shown diagrammatically in FIGS. 1 to 3 of the appended drawing.

Figure 1:
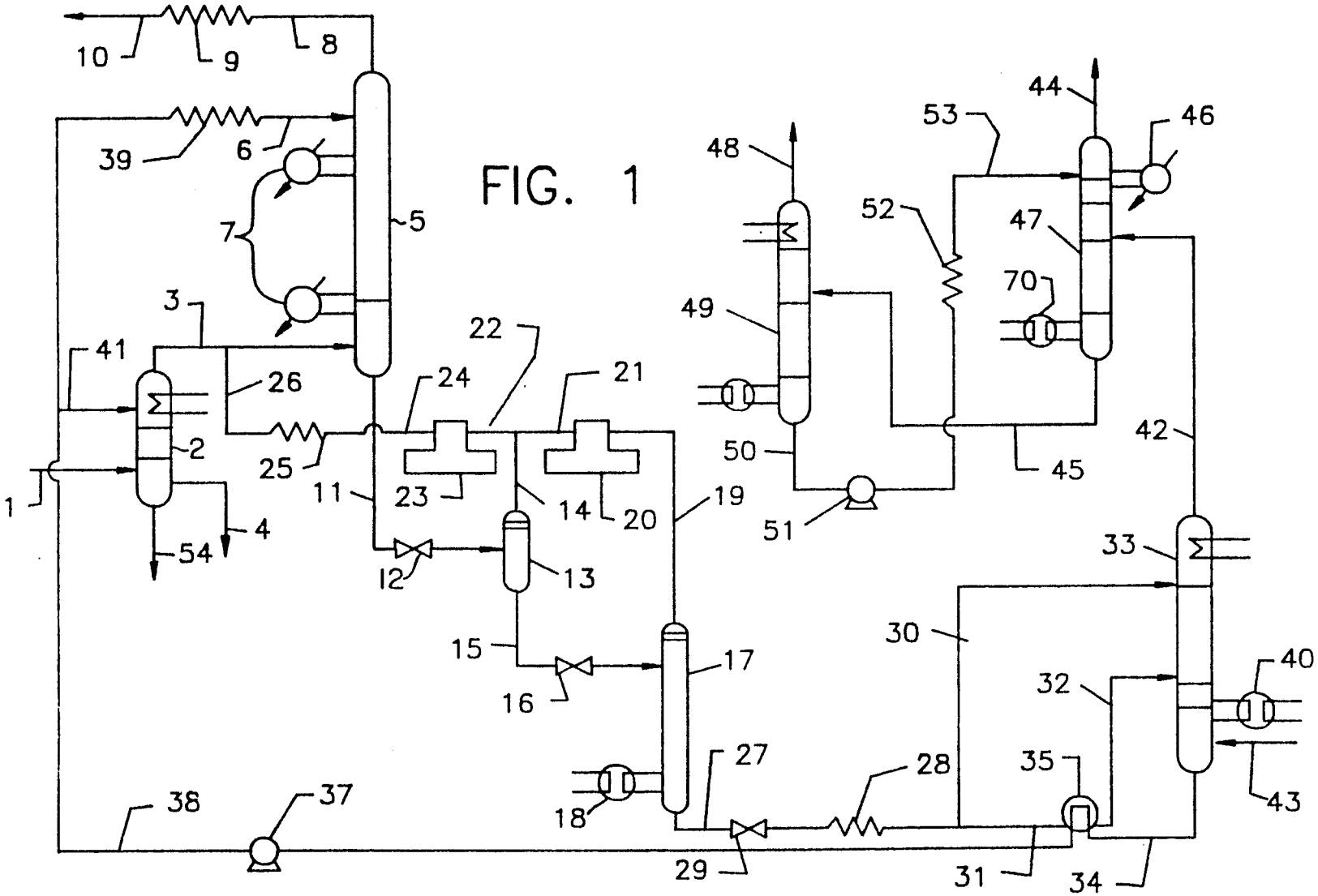
With reference to FIG. 1, the gaseous mixture to be treated delivered by the conduit 1 is introduced into the lower part of a distillation column 2, in which the gaseous mixture is distilled optionally in the presence of the solvent taken, via a conduit 41 discharging into the upper part of the column 2, from the regenerated solvent 38 delivered to the washing column 5, before the solvent travels into a refrigeration zone 39 mounted on the conduit 6 for injecting the regenerated solvent into the washing column 5, so as to produce, on the one hand, a dried gaseous mixture removed from the column 2 via a conduit 3 and whose $C_6$ and higher hydrocarbon content is lower than 0.1% by weight, and, on the other hand, a hydrocarbon cut containing virtually all of the $C_6$ and higher hydrocarbons and optionally all or part of the $C_5$ hydrocarbons, which is drawn from the bottom of column 2 via a conduit 4 and optionally a liquid drawn from the bottom of column 2 via a conduit 54 and comprising a mixture of solvent and water.

The dried gaseous mixture leaving the column 2 via the conduit 3 is introduced into the lower part of a washing column 5, for example of the tray column type, in which it is brought into contact, countercurrentwise, with the regenerated cold solvent injected into the upper part of column 5 via the conduit 6, after passing through the cooler 39, this contact being brought about at a temperature of, for example, between 0° C. and −45° C., the temperature being controlled by passing the liquid mixture present in column 5 through coolers 7. A treated gas comprising methane and depleted in $CO_2$ is removed from the top of column 5 via a conduit 8, the treated gas being reheated in a reheating system 9 and then directed, via a conduit 10, towards a utilization zone, while a liquid phase comprising the $CO_2$-enriched solvent and other absorbed compounds, and called a rich solvent, is drawn from the bottom of the column 5 via a conduit 11.

The contact between the dried gaseous mixture and the solvent in the washing column 5 is brought about at a suitable temperature in the range 0° C. to −45° C. and with a ratio of the flow rates of gaseous mixture to be treated and of solvent to make the treated gas collected via the conduit 8 at the top of the column 5 have a molar $CO_2$ content not exceeding 2% and to make the rich solvent flowing out via the conduit 11 contain at least 80 mol% of the $C_3$ and higher hydrocarbons present in the dried gaseous mixture introduced into the column 5.

The rich solvent flowing in the conduit 11 is introduced, after passing through the expansion valve 12, into the upper part of an expansion bottle 13 in which there are separated off: a first methane-rich gas which is removed at the top of the bottle 13 via a conduit 14, and a predemethanized rich solvent which is drawn from the bottom of the bottle 13 via a conduit 15. The predemethanized rich solvent is subjected to a second expansion through an expansion valve 16, followed by a distillation in a distillation column 17 provided with a reboiler 18, so as to produce a second methane-rich gas, which is removed at the top of the column 17 via a conduit 19, and a methane-depleted liquid phase, called demethanized rich solvent, which is drawn from the bottom of column 17 via a conduit 27. The second methane-rich gas flowing in the conduit 19 is led so that it passes through a compressor 20, which it leaves, via a conduit 21, at a pressure which is substantially equal to that of the first methane-rich gas flowing in the conduit 14, and then these two methane-rich gases are mixed in the conduit 22 and the gaseous phase resulting from this mixing is recycled, by means of a compressor 23 whose delivery is extended by a conduit 24, a cooler 25 and a conduit 26, into the conduit 3 for delivering the dried gaseous mixture to the washing column 5.

The demethanized rich solvent drawn from the bottom of column 17 via the conduit 27 passes through an expansion valve 29 and then a rehearing system 28, in which it is brought to a temperature close to the surrounding temperature, and it is then led to a regeneration column 33 provided with a reboiler 40 after having been split into a first stream 30, which is introduced directly into the regeneration column 33, and a second stream 31, which is introduced into the regeneration column after having been reheated in an indirect heat exchanger 35. The regeneration may be carried out in the presence of a stream of inert gas, especially a nitrogen stream, injected into the lower part of the column 33 via a conduit 43. The regeneration produces, on the one hand, a regenerated solvent drawn from the bottom of the column 33 via a conduit 34 and employed in the heat exchanger 35 to reheat the second stream 31 of demethanized rich solvent to be regenerated, before being recycled, using the pump 37 and the conduit 38, to the washing column 5 and, on the other hand, a gaseous mixture removed at the top of the column 33 via a conduit 42 and containing the $CO_2$ and the $C_2$ and higher hydrocarbons present in the demethanized rich solvent.

The gaseous mixture flowing in the conduit 42 is washed countercurrentwise in a washing tower 47 equipped with a cooler 46 at the top and a reboiler 70 at the bottom and operating at low temperature, by means of $C_5$ and higher hydrocarbon solvent delivered to the washing tower 47 via a conduit 53, the washing producing, on the one hand, a $CO_2$-rich acidic gas stream 44 which contains virtually all the $CO_2$ present in the demethanized rich solvent and which has a hydrocarbon content, expressed as methane equivalent, lower than 10 mol% relative to the $CO_2$ and, on the other hand, a rich hydrocarbon solvent 45 practically free from $CO_2$ and containing almost all the $C_2$ and higher hydrocarbons present in the gaseous mixture delivered by the conduit 42.

The rich hydrocarbon solvent 45 is led to a regeneration column 49 in which the solvent 45 is subjected to a distillation to produce, on the one hand, a hydrocarbon fraction 48 constituting the $C_2$ and higher hydrocarbon cut containing at least 80 mol% of the $C_3$ and higher hydrocarbons contained in the gas to be treated delivered to the washing column 5 via the conduit 3, and, on the other hand, a regenerated hydrocarbon solvent 50 which is recycled, using the pump 51, to the washing column 47 after refrigeration in the system 52 and passing through the conduit 53.

Figure 2:
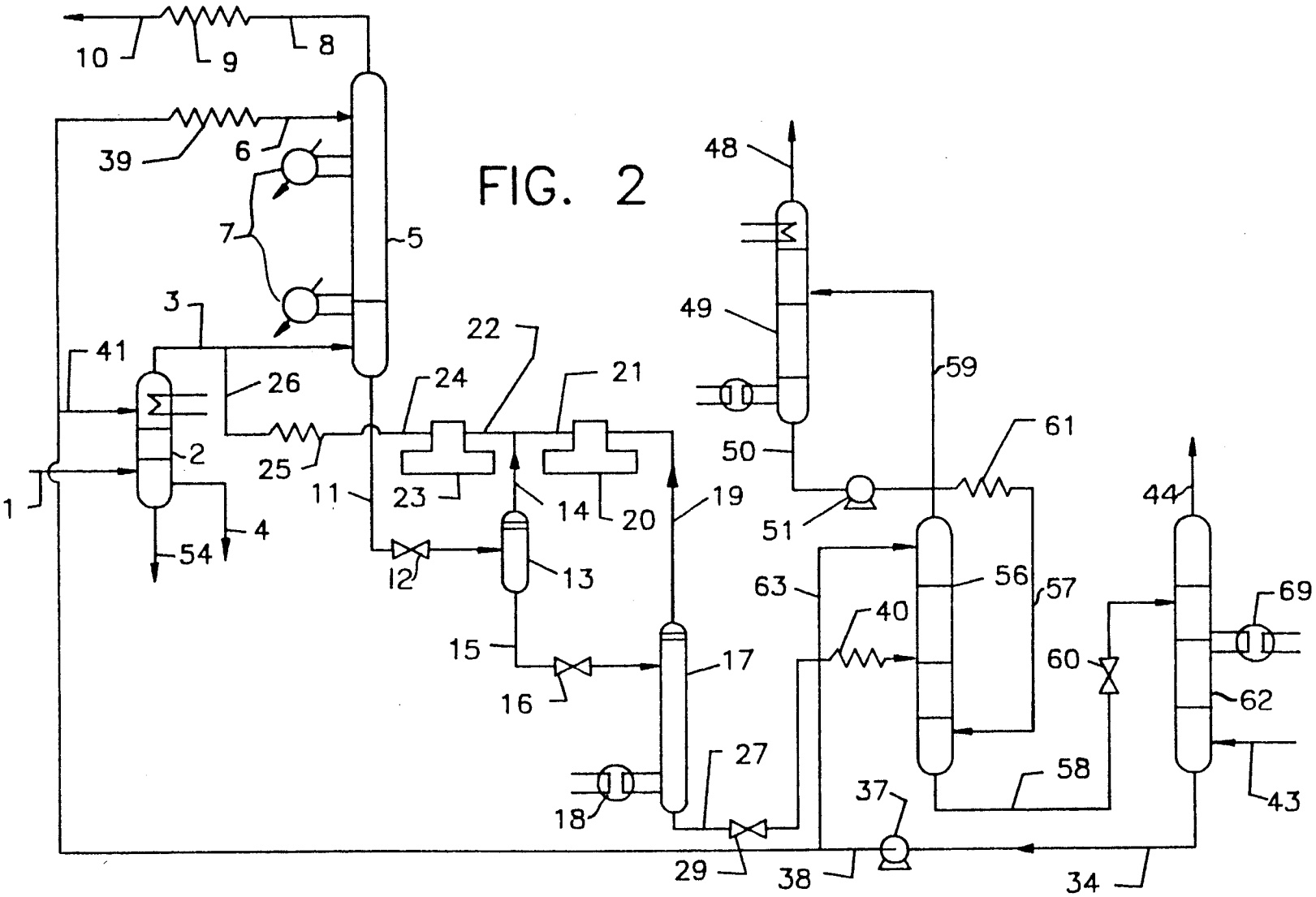

The embodiment of the process according to the invention which is illustrated in FIG. 2 differs from the embodiment illustrated by FIG. 1 solely in the treatment of the demethanized rich solvent available at the outlet of the expansion valve 29 fitted in the conduit 27 through which the demethanized rich solvent is drawn from the bottom of the demethanization column 17. The operations performed in the column 2, and similarly the operations of bringing the gas to be treated into contact with the solvent in the washing column 5 and of demethanization of the rich solvent are therefore identical with those described with reference to FIG. 1.

The demethanized rich solvent expanded by passing through the expansion valve 29 is refrigerated in the refrigerating system 40, the result being the demixing of the solvent into two liquid phases, namely a hydrocarbon upper phase and a lower phase comprising the solvent containing most of the $CO_2$ and a certain quantity of hydrocarbons. The whole is introduced into an extraction tower 56, in which it is brought into contact, countercurrentwise, with a refrigerated hydrocarbon solvent injected, using a conduit 57, into the lower part of the extraction tower, and with a regenerated solvent stream introduced into the tower 56 using a conduit 63, so as to produce, on the one hand, a purified solvent containing virtually all the $CO_2$ present in the demethanized rich solvent, the said purified solvent being drawn from the bottom of the extraction tower 56 via a conduit 58 in which an expansion valve 60 is fitted, and, on the other hand, a hydrocarbon solvent enriched in $C_2$ and higher hydrocarbons, containing little $CO_2$, the solvent being removed at the top of the extraction tower 56 via a conduit 59.

The enriched hydrocarbon solvent 59 is introduced into a regeneration column 49 in which the solvent is fractionated by a distillation into a $C_2$ and higher hydrocarbon fraction which is removed at the top of the column 49 via a conduit 48 and which constitutes the $C_2$ and higher hydrocarbon cut containing at least 80 mol% of the $C_3$ and higher hydrocarbons present in the gas to be treated delivered to the washing column 5 via the conduit 3, and into a regenerated hydrocarbon solvent drawn from the bottom of the column 49 via a conduit 50, which regenerated hydrocarbon solvent is recycled using the pump 51, through the refrigerating system 61 and the conduit 57, to the extraction tower 56.

On leaving the expansion valve 60, the purified solvent flowing in the conduit 58 is introduced into the upper part of a regeneration column 62 provided with a reheater 69, in which column the said purified solvent is subjected to a regeneration comprising a stripping operation with the aid of a stream of inert gas, for example a nitrogen stream, injected into the lower part of the column 62 via a conduit 43. The regeneration produces, on the one hand, a regenerated solvent 34 which is recycled by means of a pump 37 and of a conduit 38 to the washing column 5 through the heat exchanger 39 and the conduit 6, and, on the other hand, a $CO_2$-rich acidic gas stream 44 which contains virtually all the $CO_2$ present in the demethanized rich solvent and which has a hydrocarbon content, expressed as methane equivalent, lower than 10 mol% relative to $CO_2$.

Part of the cold regenerated solvent flowing in the conduit 38 is diverted via a conduit 63 to be injected into the extraction tower 56 at a point in this tower which is situated above the injection point of the demethanized rich solvent flowing in the conduit 27.

Figure 3:
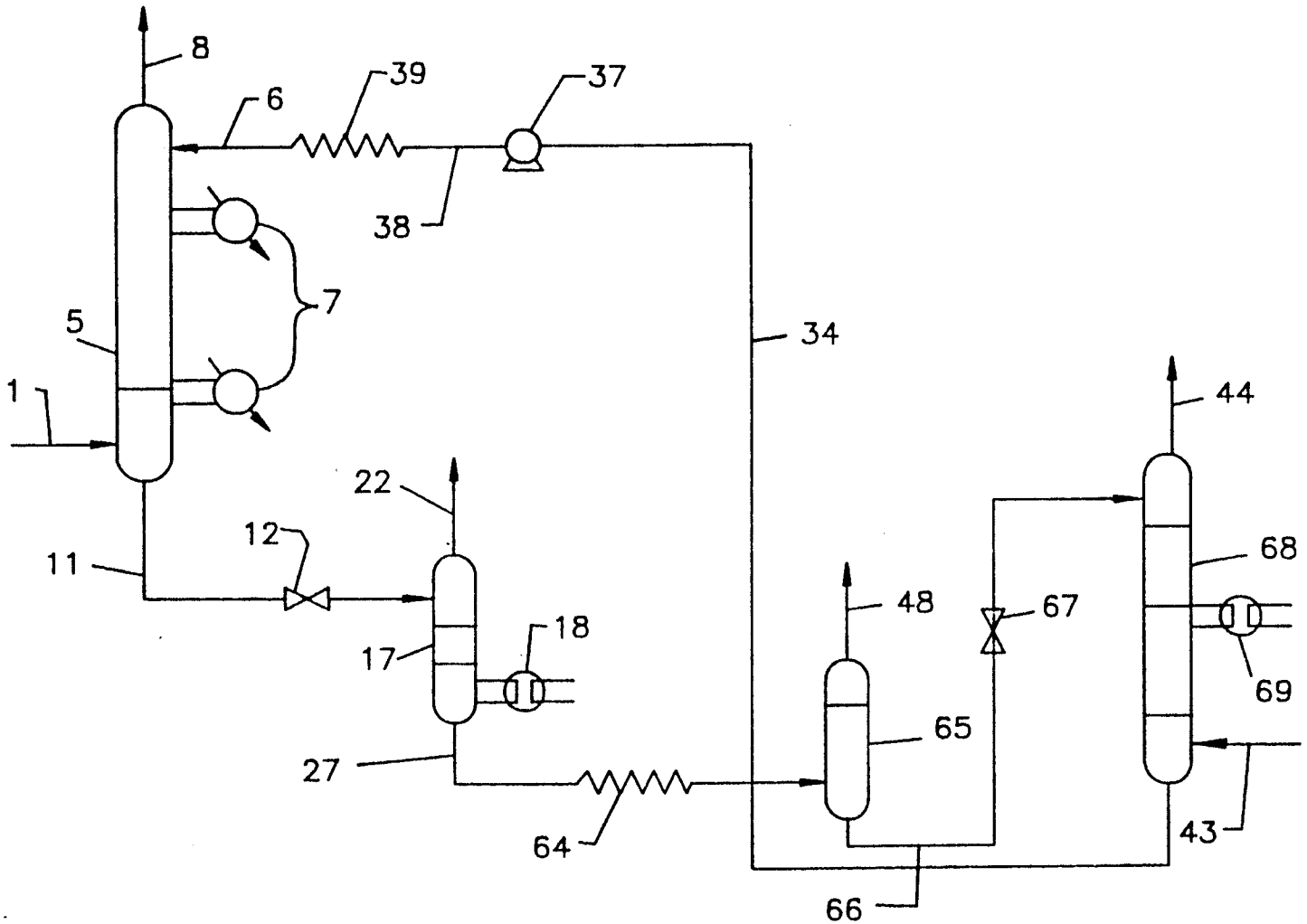

In the embodiment of the process according to the invention which is illustrated in FIG. 3 the gaseous mixture to be treated, delivered by a conduit 1, is introduced into the lower part of a washing column 5, for example of the tray column type, in which it is brought into contact, countercurrentwise, with a solvent injected into the upper part of the column 5 via a conduit 6, this contact being brought about at a temperature which is, for example, between 0° C. and −45° C. A treated gas consisting chiefly of methane and depleted in $CO_2$ is collected, via a conduit 8, at the top of the column 5, while a liquid phase made up of the solvent enriched in $CO_2$ and other absorbed compounds, and called rich solvent, is drawn from the bottom of the said column via a conduit 11. The contact between the gaseous mixture to be treated and the solvent in the column 5 is brought about at a suitable temperature in the range 0° C. to −45° C. and with a ratio of the flow rates of the gaseous mixture to be treated and of the solvent such as, on the one hand, to make the treated gas collected via the conduit 8 at the top of the column 5 have a molar $CO_2$ content not exceeding 2% and, on the other hand, to make the rich solvent flowing in the conduit 11 contain at least 80 mol% of the $C_3$ and higher hydrocarbons which are present in the gaseous mixture to be treated.

The treated gas collected via the conduit 8 at the temperature prevailing in the washing column 5 may be delivered to a distribution grid after reheating or may, if appropriate, be subjected beforehand to one or more additional treatments to complete its purification. Control of the temperature profile in the column 5 is performed by means of coolers 7 which carry the liquid medium present in the column 5

After passing through an expansion valve 12, the rich solvent flowing in the conduit 11 is introduced into the upper part of the demethanization column 17, consisting of a distillation column with reboiling 18 and in which the rich solvent is fractionated into a methane-rich gaseous phase, which is removed at the top of the column 17 via a conduit 22, and into a methane-depleted liquid phase, called demethanized rich solvent, which is drawn from the bottom of the column 17 via a conduit 27.

The demethanized rich solvent is led into a refrigeration zone 64, in which it is cooled to a temperature of, for example, between −25° C. and −80° C. and sufficiently lower than the temperature prevailing in the washing zone 5 to cause a demixing of the demethanized rich solvent into two fractions which separate in a separator 65 into a lower liquid fraction drawn from the bottom of the separator via a conduit 66, the fraction being called purified solvent and consisting of the solvent containing virtually all the $CO_2$ present in the demethanized rich solvent and having a hydrocarbon content, expressed as methane equivalent, lower than 10 mol% relative to $CO_2$, and into an upper liquid fraction, called $C_2$ and higher hydrocarbon cut and containing at least 80 mol% of the $C_3$ and higher hydrocarbons present in the gaseous mixture to be treated delivered via the conduit 1, the hydrocarbon cut being removed from the separator 65 via a conduit 48.

After passing through an expansion valve 67, the purified solvent flowing in the conduit 66 is introduced into the upper part of a regeneration column 68 provided with a reheater 69, in which the purified solvent is subjected to a regeneration by stripping with the aid of a stream of inert gas, for example a nitrogen stream, injected into the lower part of the column 68 via a conduit 43.

The regeneration produces, on the one hand, a regenerated solvent 34, which is recycled by means of a pump 37 and of a conduit 38 to the washing column 5 through a heat exchanger 39 and the conduit 6, and, on the other hand, a $CO_2$-rich acidic gas stream 44 which contains virtually all the $CO_2$ present in the demethanized rich solvent and has a hydrocarbon content, expressed as methane equivalent, lower than 10 mol% relative to $CO_2$.

The embodiment illustrated in FIG. 3 could also be modified to include the stages of pretreatment of the gaseous mixture to be treated and of demethanization in two stages, which are included in the embodiments illustrated in FIGS. 1 and 2.

To complete the above description, two examples of application of the process according to the invention are given below, no limitation being implied.

EXAMPLE 1

A gaseous mixture which had the following molar composition was treated with the aid of a plant similar to that shown diagrammatically in FIG. 1 of the appended drawing and operating as described above:

| | |
|---|---|
| $CO_2$ | 18% |
| Methane | 71.5% |
| Ethane | 5.1% |
| Propane | 1.8% |
| Butane | 1.8% |
| Hexane | 1.8% |

The gaseous mixture to be treated, delivered by the conduit 1 at a rate of 10,000 kmol/h, a temperature of 30° C. and a pressure of 5,000 kPa was introduced into the column 2 for removing the $C_6$ and higher hydrocarbons. Since the gaseous mixture to be treated in this example was dry, no solvent addition was performed via the conduit 41.

352 kmol/h of a heavy hydrocarbon cut at a pressure of 5,000 kPa and a temperature of 30° C. were removed via the conduit 4 of the column 2, the cut having the following composition:

| | |
|---|---|
| $CO_2$ | 9.26% |
| Methane | 18% |
| Ethane | 5.01% |
| Propane | 4.71% |
| Butane | 12.05% |
| Hexane | 50.97% |

9648 kmol/h of a pretreated gaseous mixture at a temperature of −20° C. and a pressure of 4950 kPa were removed via the conduit 3 at the top of the column 2, the pretreated gaseous mixture having the following molar composition:

| | |
|---|---|
| $CO_2$ | 18.32% |
| Methane | 73.45% |
| Ethane | 5.10% |
| Propane | 1.69% |
| Butane | 1.43% |
| Hexane | 0.01% |

The pretreated gaseous mixture was brought into contact with 6000 kmol/h of solvent consisting of a mixture of methanol and water in a molar ratio of 95:5 and at a pressure of 5000 kPa and a temperature of −30° C., the contact being brought about in a washing column 5 comprising 14 trays and operating at −30° C. at a pressure of 4900 kPa. The coolers 7 with which the washing column 5 was equipped enabled the temperature in the said column to be held at the desired value.

7405 kmol/h of a treated gas at a pressure of 4900 kPa and a temperature of −30° C. were removed at the top of the column 5 via the conduit 8, the treated gas having the following molar composition:

| | |
|---|---|
| $CO_2$ | 1.42% |
| Methane | 95.67% |
| Ethane | 2.90% |
| Methanol | 0.01% |

9182 kmol/h of rich solvent which had a temperature of −30° C. and a pressure of 4900 kPa were drawn from the bottom of the washing column 5 via the conduit 11, the rich solvent having the following molar composition:

| | |
|---|---|
| $CO_2$ | 21.15% |
| Methane | 6.11% |
| Ethane | 3.99% |
| Propane | 1.88% |
| Butane | 1.52% |
| Methanol | 62.07% |
| Water | 3.27% |

The treated gas, removed via the conduit 8, was reheated up to the surrounding temperature in the heat exchanger system 9, which makes it possible to ensure the refrigeration of the solvent in the cooler 39. The reheated treated gas is led via the conduit 10 towards a gas distribution pipeline.

The demethanization of the rich solvent comprised first of all a first expansion of the said solvent to a pressure of 3000 kPa, the expanded rich solvent feeding the expansion bottle 13 in which there were produced 362 kmol/h of a first gas containing 68 mol% of methane, which was removed at the top of the bottle 13 via the conduit 14, and a predemethanized rich solvent drawn from the bottom of the bottle via the conduit 15 and in which the molar content of methane was reduced from 6.11% to 3.57%. The predemethanized rich solvent, whose temperature was −33.6° C., was expanded in the valve 16 and was then fed to the distillation column 17 comprising 10 trays and operating at 1800 kPa. Column 17 produced 577 kmol/h of a second methane-rich gas, removed via the conduit 19 at a pressure of 1800 kPa and a temperature of −37° C., and a demethanized rich solvent drawn from the bottom of column 17 via the conduit 27 at a rate of 8243 kmol/h, a pressure of 1800 kPa and a temperature of −8.2° C.

The demethanized rich solvent had the following molar composition:

| | |
|---|---|
| $CO_2$ | 20.16% |
| Methane | 0.03% |
| Ethane | 3.37% |
| Propane | 1.98% |
| Butane | 1.67% |
| Methanol | 69.13% |
| Water | 3.64% |

The second methane-rich gas was compressed in the compressor 20 up to the pressure of the first methane-rich gas, namely 3000 kPa. The compressed gas leaving the compressor 20 via the conduit 21 was mixed with the first methane-rich gas to constitute the methane-rich gaseous phase 22, which was then compressed in the compressor 23 up to the pressure of the gaseous mixture to be treated, namely 5000 kPa, the said compressed gaseous phase being added through the conduit 24, the cooler 25 and the conduit 26, to the pretreated gaseous mixture flowing in the conduit 3.

The methane-rich compressed gaseous phase flowing in the conduit 26 had a temperature of −20° C., a pressure of 5000 kPa and a flow rate of 938 kmol/h.

The molar composition of the methane-rich gaseous phase flowing in the conduit 26 was the following:

| | |
|---|---|
| $CO_2$ | 29.80% |
| Methane | 59.50% |
| Ethane | 9.45% |
| Propane | 0.97% |
| Butane | 0.26% |
| Methanol | 0.02% |

After being expanded in the valve 29 and reheated in the reheating system 28, the demethanized rich solvent had a temperature of 10° C. and a pressure of 800 kPa. The reheated solvent was then split into a first stream 30 which had a flow rate of 4533 kmol/h, which was led directly towards the regeneration column 33, and into a second stream 31 which was reheated to 70° C. in the heat exchanger 35 before being conveyed the regeneration column 33. This column operated at a pressure of 700 kPa and comprised 18 trays, the streams 30 and 31 being injected at the height of trays 8 and 12 respectively, counting from the top of the column.

The regeneration column 33 produced at the top a gaseous mixture containing $CO_2$ and the $C_2$ and higher hydrocarbons, which was removed via the conduit 42 at a temperature of −14° C., a pressure of 700 kPa and a flow rate of 2244 kmol/h and, at the bottom, a regenerated solvent drawn from the bottom of the regeneration column 33 via the conduit 34.

The gaseous mixture flowing in the conduit 42 had the following molar composition:

| | |
|---|---|
| $CO_2$ | 74.07% |
| Methane | 0.12% |
| Ethane | 12.36% |
| Propane | 7.28% |
| Butane | 6.13% |
| Hexane | 0.04% |

The regenerated solvent was cooled by passing through the heat exchanger 35 and then recompressed to a pressure of 5000 kPa using the pump 37, and it was then led via the conduit 38, on the one hand, in a major quantity towards the washing column 5, through the cooler 39 and the conduit 6.

The gaseous mixture flowing in the conduit 42 was washed countercurrentwise in the washing tower 47 with the aid of a hydrocarbon solvent consisting predominantly of hexane. The tower 47 comprised 35 trays and operated at a pressure of 700 kPa at a temperature of −30° C. at the top at the level of the cooler 46.

The solvent feed to the tower 47, via the conduit 53, and that of the gaseous mixture, via the conduit 42, were introduced onto the first tray and onto tray 21 of the tower respectively. The washing tower 47 produced at the top a $CO_2$-rich acidic gas stream 44 which had a hydrocarbon content, expressed as methane equivalent, lower than 10 mol% relative to $CO_2$, the said acidic gas stream having a temperature of −30° C., a pressure of 650 kPa and a flow rate of 1685 kmol/h, and at the bottom a hydrocarbon solvent 45 with a reduced $CO_2$ content which had a temperature of 95.8° C., a pressure of 730 kPa and a flow rate of 5059 kmol/h.

The molar composition of the acidic gas stream 44 was the following:

| | |
|---|---|
| $CO_2$ | 98.65% |
| Methane | 0.15% |
| Ethane | 0.98% |
| Butane | 0.05% |
| Hexane | 0.17% |

The hydrocarbon rich solvent 45 had the following molar composition:

| | |
|---|---|
| Ethane | 5.16% |
| Propane | 3.23% |
| Butane | 3.69% |
| Hexane | 87.91% |

Fractionation of the hydrocarbon rich solvent 45 in the column 49 provided with 28 trays and operating at a pressure of 600 kPa produced at the top 561 kmol/h of a $C_2$ and higher hydrocarbon cut 48 at a temperature of 18° C. and a pressure of 600 kPa and at the bottom 4500 kmol/h of regenerated hydrocarbon solvent at a temperature of 142.7° C. and a pressure of 670 kPa, the solvent containing, on a molar basis, 98.89% of hexane and 1.11% of butane.

The molar composition of the $C_2$ and higher hydrocarbon cut 48 was the following:

| | |
|---|---|
| $CO_2$ | 0.02% |
| Ethane | 46.49% |
| Propane | 29.10% |
| Butane | 24.37% |

-continued

| | |
|---|---|
| Hexane | 0.02% |

EXAMPLE 2

A gaseous mixture which had the same composition, temperature, pressure and flow rate as the gaseous mixture of Example 1 was treated with the aid of a plant similar to that shown diagrammatically in FIG. 2 of the appended drawing and operating as described above.

Pretreatment of the gaseous mixture in the column 2, to remove $C_6$ and higher hydrocarbons therefrom was carried out under the conditions of Example 1 and from the column 2 there were removed, on the one hand, via the conduit 3, a pretreated gaseous mixture and, on the other hand, via the conduit 4, a heavy hydrocarbon cut exhibiting the same composition, temperature, pressure and flow rate characteristics as those of the pretreated gaseous mixture and of the heavy hydrocarbon cut which were obtained in Example 1.

The pretreated gaseous mixture was brought into contact with 11,500 kmol/h of solvent at a temperature of −20° C. and a pressure of 5000 kPa and containing, on a molar basis, 82.34% of methanol, 14.67% of water and 2.88 of hexane, the contact being brought about in a washing column 5 comprising 14 trays and operating at −20° C. at a pressure of 4900 kPa. The coolers 7 with which the washing column 5 was equipped allowed the temperature in the said column to be held at the desired value.

7499 kmol/h of a treated gas at a pressure of 4900 kPa and a temperature of −20° C. were removed via the conduit 8 at the top of the column 5, the treated gas having the following molar composition:

| | |
|---|---|
| $CO_2$ | 1.68% |
| Methane | 94.44% |
| Ethane | 3.78% |
| Methanol | 0.02% |

The treated gas removed via the conduit 8 was reheated up to the surrounding temperature in the heat exchanger system 9, the warmed-up treated gas being led via the conduit 10 towards a gas distribution pipeline.

14,655 kmol/h of rich solvent at a temperature of −20° C. and a pressure of 4900 kPa were drawn from the bottom of the washing column via the conduit 11, the rich solvent having the molar composition below:

| | |
|---|---|
| $CO_2$ | 13.64% |
| Methane | 3.70% |
| Ethane | 2.10% |
| Propane | 1.23% |
| Butane | 0.98% |
| Hexane | 2.24% |
| Methanol | 64.61% |
| Water | 11.51% |

The demethanization of the rich solvent comprised first of all a first expansion of the solvent to a pressure of 3000 kPa, the expanded rich solvent feeding the expansion bottle 13, in which there were produced 401 kmol/h of a first gas containing 64 mol% of methane, which was removed at the top of the bottle 13 via the conduit 14, and a predemethanized rich solvent drawn from the bottom of the said bottle via the conduit 15 and in which the molar content of methane had been reduced from 3.70 to 2.01%. The predemethanized rich solvent, whose temperature was −22.5° C., was expanded in the valve 16 and was then fed to the distillation column 17 comprising 10 trays and operating at 1800 kPa.

The column 17 produced 604 kmol/h of a second methane-rich gas, removed via the conduit 19 at a pressure of 1800 kPa and at a temperature of −25° C., and a demethanized solvent drawn from the bottom of the column 17 via the conduit 27 at a rate of 13,649 kmol/h, a temperature of 1° C. and a pressure of 1800 kPa.

The demethanized rich solvent flowing in the conduit 27 had the following molar composition:

| | |
|---|---|
| $CO_2$ | 12.11% |
| Methane | 0.03% |
| Ethane | 1.53% |
| Propane | 1.20% |
| Butane | 1.01% |
| Hexane | 2.39% |
| Methanol | 69.37% |
| Water | 12.36% |

The second methane-rich gas was compressed in the compressor 20 up to the pressure of the first methane-rich gas, namely 3000 kPa. The compressed gas leaving the compressor 20 via the conduit 21 was mixed with the first methane-rich gas to constitute the methane-rich gaseous phase 22, which was then compressed in the compressor 23 up to the pressure of the gaseous mixture to be treated, namely 5000 kPa, the compressed gaseous phase being added through the conduit 24, the cooler 25 and the conduit 26, to the pretreated gaseous mixture flowing in the conduit 3.

The methane-rich compressed gaseous phase flowing through the conduit 26 had a temperature of −20° C., a pressure of 5000 kPa and a flow rate of 1006 kmol/h. The molar composition of the methane-rich gaseous phase flowing in the conduit 26 was the following:

| | |
|---|---|
| $CO_2$ | 34.31% |
| Methane | 53.50% |
| Ethane | 9.84% |
| Propane | 1.70% |
| Butane | 0.53% |
| Hexane | 0.09% |
| Methanol | 0.03% |

The demethanized rich solvent expanded in the valve 29 and refrigerated to −40° C. in the refrigerating system 40 was brought into contact, countercurrentwise, in the liquid/liquid extraction tower 56 with a refrigerated hydrocarbon solvent containing predominantly hexane, the hydrocarbon solvent consisting, on a molar basis, of 95.77% of hexane, 1.11% of butane and 3.12% of methanol. The extraction tower 56 comprised 31 trays and was fed on the first tray with 5000 kmol/h of regenerated solvent delivered via the conduit 63 at a temperature of −40° C., on tray 21 with the demethanized rich solvent originating from the refrigeration system 40 and on tray 31 with the hexane-based refrigerated hydrocarbon solvent delivered via the conduit 57 at a rate of 1600 kmol/h. This extraction produced 2079 kmol/h of a rich hydrocarbon solvent which had a temperature of −40° C. and a pressure of 1200 kPa, the said rich hydrocarbon solvent being removed at the top of the tower 56 via the conduit 59, and 18,069 kmol/h of purified solvent drawn from the bottom of the said tower, via the conduit 58, at a temperature of −40° C. and at a pressure of 1200 kPa.

The molar composition of the rich hydrocarbon solvent flowing in the conduit 59 was the following:

| | |
|---|---|
| $CO_2$ | 0.14% |
| Methane | 0.13% |
| Ethane | 9.19% |
| Propane | 7.79% |
| Butane | 6.62% |
| Hexane | 73.72% |
| Methanol | 2.40% |

The molar composition of the purified solvent flowing in the conduit 58 was the following:

| | |
|---|---|
| $CO_2$ | 9.16% |
| Methane | 0.01% |
| Ethane | 0.10% |
| Propane | 0.01% |
| Hexane | 2.42% |
| Methanol | 74.91% |
| Water | 13.40% |

By fractionating the enriched hydrocarbon solvent 59 in the regeneration column 49 comprising 28 trays and operating at 700 kPa, there were produced, on the one hand, at the top of the column 49, 497 kmol/h of a $C_2$ and higher hydrocarbon cut at a temperature of 28° C. and a pressure of 700 kPa, which was removed via the conduit 48, and, on the other hand, at the bottom of the column, 1600 kmol/h of regenerated hydrocarbon solvent at a temperature of 142.7° C. and a pressure of 670 kPa, which was drawn off at the bottom via the conduit 50.

The $C_2$ and higher hydrocarbon cut removed via the conduit 48 had the following molar composition:

| | |
|---|---|
| $CO_2$ | 0.59% |
| Methane | 0.54% |
| Ethane | 38.40% |
| Propane | 32.58% |
| Butane | 27.67% |
| Hexane | 0.20% |
| Methanol | 0.02% |

The regenerated hydrocarbon solvent flowing in the conduit 50 contained, on a molar basis, 95.77% of hexane, 1.11% of butane and 3.12% of methanol. The said solvent was taken, in the pump 51, up to a pressure of 1200 kPa, and was then refrigerated to −40° C. in the refrigerating system 61, before being recycled to the extraction tower 56 via the conduit 57.

The purified solvent flowing, via the conduit 58, out of the extraction tower 56 was expanded to a pressure of 200 kPa in the expansion valve 60 and was then introduced into the regeneration column 62 for the purpose of regeneration. The said column 62, comprising 14 trays and operating at a pressure of 200 kPa was fed on the first tray with the purified solvent to be regenerated and on the last tray with a nitrogen stream delivered, via the conduit 43, at a flow rate of 650 kmol/h. The reheater 69, with which the said column 62 was equipped, was situated on the seventh tray.

The regeneration of the purified solvent produced, on the one hand, 2289 kmol/h of a $CO_2$-rich acidic gas stream, the stream being removed via the conduit 44 at the top of the column 62 and, on the other hand, a regenerated solvent drawn from the bottom of the column 62 via the conduit 34.

The $CO_2$-rich acidic gas stream removed via the conduit 44 was at a pressure was 200 kPa and a temperature of −47.5° C. and had the following molar composition:

| | |
|---|---|
| $CO_2$ | 71.64% |
| Methane | 0.05% |
| Ethane | 0.77% |
| Propane | 0.04% |
| Hexane | 0.40% |
| Methanol | 0.06% |
| Nitrogen | 27.04% |

The regenerated solvent flowing in the conduit 34 was raised to the pressure of 5000 kPa by passing through the pump 37 and was then split into two parts, namely a major part recycled towards the washing column 5 after passing through the heat exchanger system 39 and the conduit 6, and a part led into the extraction tower 56 via the conduit 63.

We claim:

1. A process for the simultaneous decarbonation and gasoline stripping of a gaseous mixture containing methane, $C_2$ and higher hydrocarbons and $CO_2$, at an absolute pressure higher than the 0.5 MPa, which comprises the steps of:

a) contacting the gaseous mixture in a decarbonation and gasoline stripping zone, with a liquid solvent which dissolves $CO_2$ and $C_2$ and higher hydrocarbons preferentially and which has a boiling temperature at atmospheric pressure higher than about 40° C. and a viscosity at about −30° C. lower than about 0.1 Pa s, said liquid solvent comprised of at least one liquid organic absorbent employed in anhydrous form or as a mixture with water, the at least one absorbent being selected from the group consisting of amides of the formula

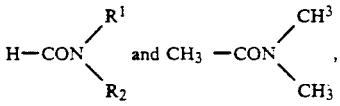

aldehydes of the formula

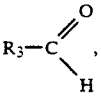

esters of the formulae

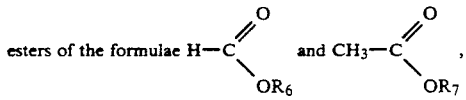

$C_1$–$C_4$ alkanols, diethers of the formula $CH_3O$—$(—C_2H_4O—)_n—CH_3$, diether alcohols of the formula $R_9O—C_2H_4—O—C_2—H_4—OH$, lactones of the formula

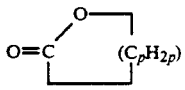

and propylene carbonate, wherein $R_1$ and $R_2$, which are identical or different, denote a hydrogen atom or a $C_1$ or $C_2$ alkyl radical, $R_3$ being a $C_3$ or $C_4$ alkyl radical, $R_6$ being a $C_2$–$C_4$ alkyl radical or a $—(—C_2H_4O—)_n—R_8$ radical with $R_8$ denoting a $C_1$ or $C_2$ alkyl radical and n representing 1 or 2, $R_7$ being a $C_1$ or $C_2$ alkyl radical or a $—(C_2H_4O—)_n—R_8$ radical, $R_9$ denoting $C_1$–$C_4$ alkyl radical and p being an integer ranging from 2 to 4; said contacting being carried out at a low temperature and with a ratio of the flow rates of the gaseous mixture to be treated and of the solvent sufficient to produce a treated gas containing a major portion of methane and a $CO_2$ molar content not exceeding about 2% and a liquid phase, rich, solvent containing $CO_2$ and $C_2$ and higher hydrocarbons containing at least about 80 mol % of $C_3$ and higher hydrocarbons which were present in the gaseous mixture to be treated;

b) subjecting the liquid phase rich solvent to at least partial demethanization treatment by expanding said liquid phase rich solvent so as to produce a methane-depleted, liquid phase, demethanized, rich solvent and a methane-rich gaseous phase;

c) extracting in liquid form the $C_2$ and higher hydrocarbons contained in the demethanized rich solvent by bringing a cooled, demethanized, rich solvent into contact with a hydrocarbon solvent, in an extraction zone, to produce a purified solvent which contains substantially all of the $CO_2$ present in the demethanized rich solvent and has a hydrocarbon content, expressed as methane equivalent, lower than about 10 mol % relative to $CO_2$, and an enriched hydrocarbon solvent enriched in $C_2$ and higher hydrocarbons;

d) regenerating the purified solvent by stripping to produce a regenerated solvent, which is recycled to the decarbonation and gasoline stripping zone, and a $CO_2$- rich acidic gas stream containing less than about 10 mol % of hydrocarbons, expressed as methane equivalent, in relation to $CO_2$; and e) fractionating the enriched hydrocarbon solvent by distillation to form a hydrocarbon cut comprised of a mixture of $C_2$ and higher hydrocarbons containing at least about 80 mol % of the $C_3$ and higher hydrocarbons which were present in the gaseous mixture to be treated and a regenerated hydrocarbon solvent which is recycled, after refrigeration, to the extraction zone of step (c).

2. A process according to claim 1, whereas solvent brought into contact with the gaseous mixture to be treated has a viscosity lower than about 0.05 Pa s at about −30° C.

3. A process according to claim 1, wherein the temperature at which the gaseous mixture to be treated is contacted with the solvent in the decarbonation and gasoline stripping zone is between about 0° C. and −45° C.

4. A process according to claim 1, wherein the demethanization treatment applied to the rich solvent is carried out in two stages, comprising, a first stage in which the rich solvent is subjected to a first expansion to release a large fraction of the methane dissolved in the solvent and to produce a first methane-rich gas and a predetermined fluid, and a second stage in which the predemethanized fluid is subjected to a second expansion and then to a distillation to produce a second methane-rich gas and the demethanized rich solvent, the second-methane-rich gas being compressed up to the pressure of the first methane-rich gas and then mixed with the first methane-rich to form the methane-rich gaseous phase.

5. A process according to claim 1, wherein the methane-rich gaseous phase is compressed up to the pressure of the gaseous mixture to be treated, cooling the compressed gaseous phase and mixing with the gaseous mixture to be treated before the latter is brought into contact with the solvent in the decarbonation and gasoline stripping zone.

6. A process of claim 1 wherein the regeneration of the purified solvent is applied to the demethanized rich solvent and the regeneration of the purified solvent is carried out by expanding the solvent to a pressure which is higher than about 100 kPa, and stripping the demethanized rich solvent by means of an inert gas in the regeneration column.

7. A process according to claim 1 wherein the regeneration of the purified solvent is applied to the demethanized rich solvent and the regeneration of the purified solvent consists essentially of reheating the solvent up to a temperature close to the surrounding temperature, splitting the warmed-up solvent into a first and a second stream, directing the first stream directly to a regeneration zone, directing the second stream to the regeneration zone after it has been heated by indirect heat exchange with the regenerated purified solvent, and in subjecting the purified solvent to a distillation in the regeneration zone to produce the $CO_2$-rich acidic gas stream and the regenerated solvent.

8. A process according to claim 1 wherein the gaseous mixture to be treated, contains water and/or $C_5$ and higher hydrocarbons, the gaseous mixture is pretreated by a distillation carried out at a temperature at least equal to that prevailing in the decarbonation and gasoline strip zone to produce heavy hydrocarbon fraction containing substantially all of the $C_6$ and higher hydrocarbons and a part of the $C_5$ hydrocarbons a pretreated gaseous mixture which has a $C_6$ and higher hydrocarbon content lower than 0.1% by weight.

9. The process of claim 1 wherein said liquid organic absorbent is selected from the group consisting of N,N-dimethylformamide, N,N-dimethylacetamide, dimethoxymethane, diethoxymethane, 1,1-dimethoxyethane, methanol, ethanol, ethylene glycol dimethyl ether, diethylene glycol dimethyl ether, ethylene glycol monomethyl ether, butyrolactone, propiolactone and propylene carbonate.

10. A process for the simultaneous decarbonation and gasoline stripping of a gaseous mixture containing methane, $C_2$ and higher hydrocarbons and $CO_2$, at an absolute pressure higher than 0.5 MPa, which comprises the steps of:

a) contacting the gaseous mixture in a decarbonation and gasoline stripping zone, with a liquid solvent which dissolves $CO_2$ and $C_2$ and higher hydrocarbons preferentially and which has a boiling temperature at atmospheric pressure higher than about 40° C. and a viscosity at about −30° C. lower than about 0.1 Pa s, said liquid solvent comprised of at least one liquid organic absorbent employed in anhydrous form or as a mixture with water, the at least one absorbent being selected from the group consisting of amides of the formulae

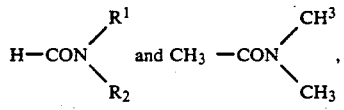

aldehydes of the formula $R_3-C(=O)H$, esters of the formulae $H-C(=O)OR_6$ and $CH_3-C(=O)OR_7$ $C_1$–$C_4$ alkanols, diethers of the formula $CH_3O-(-C_2H_4O-)_n-CH_3$, diether alcohols of the formula $R_9O-C_2H_4-O-C_2H_4-OH$, lactones of the formula

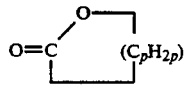

and propylene carbonate, wherein $R_1$ and $R_2$, which are identical or different, denote a hydrogen atom or a $C_1$ or $C_2$ alkyl radical, $R_3$ being a $C_3$ or $C_4$ alkyl radical, $R_6$ being a $C_2$–$C_4$ alkyl radical or a $-(-C_2H_4O-)_n-R_8$ radical with $R_8$ denoting $C_1$–$C_2$ alkyl radical and n representing 1 or 2, $R_7$ being a $C_1$–$C_2$ alkyl radical or a $-(-C_2H_4O-)_n-R_8$ radical, $R_9$ denoting $C_1$–$C_4$ alkyl radical and p being an integer ranging from 2 to 4; said contacting being carried out at a low temperature and with a ratio of the flow rates of the gaseous mixture to be treated and of the solvent sufficient to produce a treated gas containing a major portion of methane and a $CO_2$ molar content not exceeding about 2% and a liquid phase rich solvent containing $CO_2$ and $C_2$ and higher hydrocarbons containing at least 80 mol % of the $C_3$ and higher hydrocarbons which were present in the gaseous mixture to be treated;

b) subjecting the liquid phase rich solvent to at least partial demethanization treatment by expanding said liquid phase rich solvent so as to produce a methane-depleted liquid phase demethanized rich solvent and a methane-rich gaseous phase;

c) regenerating the demethanized rich solvent by distillation to produce a regenerated solvent, which is recycled to the washing zone and a gas mixture containing the $CO_2$ and the $C_2$ and higher hydrocarbons which were present in the demethanized rich solvent;

d) subjecting the gas mixture resulting from step C) to a washing operation by bringing this mixture into contact with a $C_5$ and higher hydrocarbon solvent in a decarbonation and gasoline stripping zone operating at low temperature to produce a $CO_2$-rich acidic gas stream containing less than about 10 mol % of hydrocarbons, expressed as methane equivalent, in relation to $CO_2$ and a rich hydrocarbon solvent containing substantially all of the $C_2$ and higher hydrocarbons present in the gaseous mixture; and e) fractionating the rich hydrocarbon solvent into a hydrocarbon cut comprised of a mixture of $C_2$ and higher hydrocarbons containing at least about 80 mol % of the $C_3$ and higher hydrocarbons which were present in the gaseous mixture to be treated and a regenerated hydrocarbon solvent which is recycled to the washing zone after it has been cooled.

11. A process according to claim 10 wherein the regeneration of the demethanized rich solvent is performed by reheating the solvent up to a temperature close to ambient temperature, and then splitting the warmed-up solvent into a first and a second stream, by directing the first stream directly to a regeneration zone, by directing the second stream to the regeneration zone after it has been reheated by indirect heat exchange with the regenerated solvent and by subjecting the solvent to a distillation in the regeneration zone.

12. A process according to claim 11 wherein the distillation of the solvent in the regeneration zone takes place in the presence of a stream of inert gas injected into the regeneration zone.

13. A process according to claim 10, wherein the solvent brought into contact with the gaseous mixture to be treated has a viscosity lower than about 0.05 Pa s at about −30° C.

14. A process according to claim 10, wherein the temperature at which the gaseous mixture to be treated is contacted with the solvent in the decarbonation and gasoline stripping zone is between about 0° C. and −45° C.

15. A process according to claim 10 wherein the demethanization treatment applied to the rich solvent is carried out in two stages, comprising, a first stage in which the rich solvent is subjected to a first expansion to release a large fraction of the methane dissolved in the solvent to produce a first methane-rich gas and a predemethanized fluid, and a second stage in which the predemethanized fluid is subjected to a second expansion and then to a distillation to produce a second methane-rich gas and the demethanized rich solvent, the second methane-rich gas being compressed up to the pressure of the first methane-rich gas and then mixed with the first methane-rich gas to form the methane-rich gaseous phase.

16. A process according to claim 10, wherein the methane-rich gaseous phase is compressed up to the pressure of the gaseous mixture to be treated, cooling the compressed gaseous phase and mixing with the gaseous mixture to be treated before the latter is brought into contact with the solvent in the decarbonation and gasoline stripping zone.

17. A process according to claim 10 wherein the gaseous mixture to be treated, contains water and/or $C_5$ and higher hydrocarbons, the gaseous mixture is pretreated by a distillation carried out at a temperature at least equal to that prevailing in the washing zone to produce a heavy hydrocarbon fraction containing substantially all of the $C_6$ and higher hydrocarbons and a part of the $C_5$ hydrocarbons, a pretreated gaseous mixture which has a $C_6$ and higher hydrocarbon content lower than 0.1% by weight.

18. The process of claim 10 wherein said liquid organic absorbent is selected from the group consisting of N-N-dimethylformamide, N,N-dimethylacetamide, dimethoxymethane, diethoxymethane, 1,1-dimethoxyethane, methanol, ethanol, ethylene glycol dimethyl ether, diethylene glycol dimethyl ether, ethylene glycol monomethyl ether, butyrolactone, propiolactone and propylene carbonate.

19. A process for the simultaneous decarbonation and gasoline stripping of a gaseous mixture containing methane, $C_2$ and higher hydrocarbons and $CO_2$, at an absolute pressure higher than 0.5 MPa, which comprises the steps of:

a) contacting the gaseous mixture in a decarbonation and gasoline stripping zone, with a liquid solvent which dissolves $CO_2$ and $C_2$ and higher hydrocarbons preferentially and which has a boiling temperature at atmospheric pressure higher than about 40° C. and a viscosity at about −30° C. lower than about 0.1 Pa s, said liquid solvent comprised of at least one liquid organic absorbent employed in anhydrous form or as a mixture with water, the at least one absorbent being selected from the group consisting of amides of the formulae

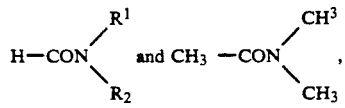

aldehydes of the formula

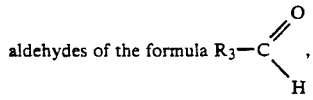

esters of the formulae

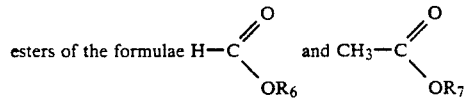

$C_1$-$C_4$ alkanols, diethers of the formula $CH_3O$—[—$C_2H_4O$—]$_n$—$CH_3$, diether alcohols of the formula $R_iO$—$C_2H_4$—O—$C_2H_4$—OH, lactones of the formula

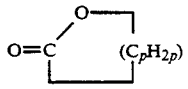

and propylene carbonate, wherein $R_1$ and $R_2$, which are identical or different, denote a hydrogen atom or a $C_1$ or $C_2$ alkyl radical, $R_3$ being a $C_3$ or $C_4$ alkyl radical, $R_63$ being a $C_2$-$C_4$ alkyl radical or a —(—$C_2H_4O$—)$_n$—$R_8$ radical with $R_8$ denoting a $C_1$ or $C_2$ alkyl radical and n representing 1 or 2, $R_7$ being a $C_1$ or $C_2$ alkyl radical or a —(—$C_2H_4O$)$_n$—$R_8$ radical, $R_9$ denoting $C_1$-$C_4$ alkyl radical and p being an integer ranging from 2 to 4; said contacting being carried out at a low temperature and with a ratio of the flow rates of the gaseous mixture to be treated and of the solvent sufficient to produce a treated gas containing a major portion of methane and a $CO_2$ molar content not exceeding about 2% and a liquid phase, rich solvent containing $CO_2$ and $C_2$ and higher hydrocarbons containing at least about 80 mol % of the $C_3$ and higher hydrocarbons which were present in the gaseous mixture to be treated;

b) subjecting the liquid phase rich solvent to at least partial demethanization treatment by expanding said liquid phase, rich solvent so as to produce a methane-depleted liquid phase demethanized rich solvent and a methane-rich gaseous phase;

c) cooling the demethanized rich solvent to a temperature which is sufficiently lower than the temperature prevailing in the washing zone to produce a demixing of the demethanized rich solvent into two fractions, comprising a lower liquid fraction comprised of a purified solvent which contains substantially all of the $CO_2$ present in the demethanized rich solvent and which has a hydrocarbon content, expressed as methane equivalent, lower than about 10 mol % relative to $CO_2$ and an upper liquid fraction comprised of a hydrocarbon cut which contains the $C_2$ and higher hydrocarbons present in the demethanized rich solvent and contains at least about 80 mol % of the $C_3$ and higher hydrocarbons of the gaseous mixture to be treated;

d) separating the upper hydrocarbon cut fraction from the lower purified solvent fraction and recovering said hydrocarbon cut fraction; and e) regenerating the purified solvent fraction by stripping to produce a regenerated solvent, which is recycled to the decarbonation and gasoline stripping zone, and a $CO_2$-rich acidic gas stream containing less than about 10 mol %of hydrocarbons, expressed as methane equivalent, in relation to $CO_2$.

20. A process of claim 19 wherein the treatment c) is applied to the demethanized rich solvent and the temperature, which is lower than the temperature prevailing in the decarbonation and gasoline stripping zone and to which the demethanized rich solvent is cooled to produce its demixing, is between about −25° C. and −80° C.

21. A process according to claim 19, whereas solvent brought into contact with the gaseous mixture to be treated has a viscosity lower than about 0.05 Pa s at about −30° C.

22. A process according to claim 19, wherein the temperature at which the gaseous mixture to be treated is contacted with the solvent in the decarbonation and gasoline stripping zone is between about 0° C. and −45° C.

23. A process according to claim 19 wherein the demethanization treatment applied to the rich solvent is carried out in two stages, comprising, a first stage in which the rich solvent is subjected to a first expansion to release a large fraction of the methane dissolved in the solvent and to produce a first methane-rich gas and a predemethanized fluid, and a second stage in which the predemethanized fluid is subjected to a second expansion and then to a distillation to produce a second methane-rich gas and the demethanized rich solvent, the second methane-rich gas being compressed up to the pressure of the first methane-rich gas and then mixed with the first methane-rich to form the methane-rich gaseous phase.

24. A process according to claim 19, wherein the methane-rich gaseous phase is compressed up to the pressure of the gaseous mixture to be treated, cooling the compressed gaseous phase and mixing with the gaseous mixture to be treated before the latter is brought into contact with the solvent in the decarbonation and gasoline stripping zone.

25. A process of claim 19 wherein the purified solvent is regenerated by expanding the purified solvent to a pressure which is higher than about 100K Pa, and stripping the preferred solvent by means of an inert gas in a regeneration column.

26. A process according to claim 19 wherein the purified solvent is regenerated by reheating the solvent to a temperature close to ambient temperature, splitting the warmed-up solvent into a first and a second stream, directing the first stream directly to a regeneration zone, directing the second stream to the regeneration zone after it has been heated by indirect heat exchange with the regenerated purified solvent and subjecting the purified solvent to a distillation in the regeneration zone to produce the $CO_2$-rich acidic gas stream and the regenerated solvent.

27. A process according to claim 19 wherein the gaseous mixture to be treated, contains water and/or $C_5$ and higher hydrocarbons, the gaseous mixture is pretreated by a distillation carried out at a temperature at least equal to that prevailing in the decarbonation and gasoline stripping zone to produce a heavy hydrocarbon fraction containing substantially all of the $C_6$ and higher hydrocarbons and a part of the $C_5$ hydrocarbons, and a pretreated gaseous mixture which has a $C_6$ and higher hydrocarbon content lower than 0.1% by weight.

28. The process of claim 19 wherein said liquid organic absorbent is selected from the group consisting of N-N-dimethylformamide, N,N-dimethylacetamide, dimethoxymethane, diethoxymethane, 1,1-dimethoxyethane, methanol, ethanol, ethylene glycol dimethyl ether, diethylene glycol dimethyl ether, ethylene glycol monomethyl ether, butyrolactone, propiolactone and propylene carbonate.

* * * * *

UNITED STATES PATENT AND TRADEMARK OFFICE

CERTIFICATE OF CORRECTION

PATENT NO. : 5,298,156

DATED : March 29, 1994

INVENTOR(S) : Claude Blanc, et al.

It is certified that error appears in the above-identified patent and that said Letters Patent is hereby corrected as shown below:

Cover page, item [22]; "Dec." should read --Nov.--

Column 1, line 17: "not 2%," should read --not exceed 2%,--;

Col. 2, line 52: "to" should read "wherein";

Col. 3, line 11: "recycled" should read --recycled to--;

Col. 3, line 45: "fractionation of" should be deleted and the expression "solvent by" should read --solvent is fractionated by--;

Col. 3, line 49: "to" should be inserted between "refrigeration" and "the extraction zone";

Col. 6, line 7: "to" should be inserted between "directly" and "a regeneration";

Col. 6, line 8: "to" should be inserted between "stream" and "this";

Col. 6, line 19: "comprises" should read --comprise--;

UNITED STATES PATENT AND TRADEMARK OFFICE

CERTIFICATE OF CORRECTION

PATENT NO. : 5,298,156

DATED : March 29, 1994

INVENTOR(S) : Claude Blanc, et al.

It is certified that error appears in the above-identified patent and that said Letters Patent is hereby corrected as shown below:

Col. 12, line 55: "to" should be inserted between "conveyed" and "the";

Col. 17, line 4: "was" second occurrence should read --of--;

Col. 17, line 27: "the" should be deleted;

Col. 17, line 35: "being" should be inserted between "solvent" and "comprised";

Col. 18, line 4: "a" should be inserted between "denoting" and "$C_1$-$C_4$ alkyl";

Col. 18, line 47: "whereas" should read --wherein--;

Col. 18, line 63: "predetermined" should read --predemethanized--;

Col. 19, line 38: "strip" should read --stripping--;

Col. 19, line 40: "and" should be inserted between "hydrocarbons" and "a pretreated";

Col. 19, line 64: "being" should be inserted between "solvent" and "comprised";

Col. 20, line 29: "$(C_2H_4O)_nR_8$" should read --$(C_2H_4O)_nR_8$--;

Col. 20, line 57: "a decarbonation and gasoline stripping zone" should read "a washing zone";

UNITED STATES PATENT AND TRADEMARK OFFICE

CERTIFICATE OF CORRECTION

PATENT NO. : 5,298,156

DATED : March 29, 1994

INVENTOR(S) : Claude Blanc, et al.

It is certified that error appears in the above-identified patent and that said Letters Patent is hereby corrected as shown below:

Col. 21, line 56: "and" should be inserted between "hydrocarbons" and "a pretreated";

Col. 22, line 10: "being" should be inserted between "solvent" and "comprised";

Col. 22, line 33: "R,O-" should read "$R_9O$-";

Col. 22, line 44: "$R_63$" should read --$R_6$--;

Column 23, lines 22-23: the sentence "the treatment c) is applied to the demethanized rich solvent and" should be deleted;

Column 23, line 29: "whereas" should be --wherein the--;

Column 24, line 3: "gas" should be added after "methane-rich";

UNITED STATES PATENT AND TRADEMARK OFFICE

CERTIFICATE OF CORRECTION

PATENT NO. : 5,298,156

DATED : March 29, 1994

INVENTOR(S) : Claude Blanc, et. al.

It is certified that error appears in the above-indentified patent and that said Letters Patent is hereby corrected as shown below:

Column 24, line 15, "preferred " should read -- purified--.

Signed and Sealed this

First Day of August, 1995

Bruce Lehman

*Attest:*

BRUCE LEHMAN

*Attesting Officer*

*Commissioner of Patents and Trademarks*